US005975140A

United States Patent [19]

Lin

[11] Patent Number: 5,975,140

[45] Date of Patent: Nov. 2, 1999

[54] GOOSENECK FAUCET

[76] Inventor: Ching-Yi Lin, 28 Fu Ma Street, Changhua, Taiwan

[21] Appl. No.: 08/901,202

[22] Filed: Jul. 28, 1997

[51] Int. Cl.[6] ..... E03C 1/02

[52] U.S. Cl. ..... 137/801; 137/359

[58] Field of Search ..... 137/359, 801

[56] References Cited

U.S. PATENT DOCUMENTS

| | | | |
|---|---|---|---|
| 3,129,894 | 4/1964 | Schermerhorn | 137/801 X |
| 4,771,485 | 9/1988 | Traylor | 137/801 X |
| 5,127,427 | 7/1992 | Kajpust et al. | 137/359 X |

*Primary Examiner*—Gerald A. Michalsky
*Attorney, Agent, or Firm*—Smith, Gambrell & Russell, LLP

[57] ABSTRACT

A gooseneck faucet is composed of a gooseneck tube, a faucet body, and a threaded tube. The gooseneck tube is provided at one end thereof with a spout and at another end thereof with a water inlet having outer threads. The faucet body is composed of a shell and an inner body. The shell is provided with a flow control valve hole and a water outlet having inner threads, whereas the inner body is provided with a control valve water tract and a water discharging tract. The threaded tube is provided with a fastening nut for fastening one end of the threaded tube with a drinking fountain. The threaded tube is fastened at another end thereof with one end of the control valve water tract of the inner body of the faucet body. The gooseneck tube is fastened at another end thereof with the faucet body such that the outer threads of the water inlet of the gooseneck tube are engaged with the inner threads of the water outlet of the shell of the faucet body.

6 Claims, 4 Drawing Sheets

GOOSENECK FAUCET

FIELD OF THE INVENTION

The present invention relates generally to a faucet, and more particularly to a gooseneck faucet.

BACKGROUND OF THE INVENTION

As shown in FIG. 1, a prior art gooseneck faucet is composed of a faucet body A, a gooseneck tube B, a threaded tube C, a bottom seat ring D, a leakproof washer E, and a metal washer F. The gooseneck tube B has a spout B4 which is provided with a protective jacket B1. and a water inlet B3 having outer threads B2. The faucet body A is provided therein with a control valve tract A3 and a water discharging tract A4. The control valve tract A3 is provided therein with a flow control valve A1. The threaded tube C is provided with a nut C1, a compression sleeve C2 and a compression nut C3. The bottom seat ring D, the leakproof washer E and the metal washer F are mounted on the threaded tube C.

Such a prior art gooseneck faucet as described above is defective in design in that the faucet body A is made of lead by casting, and that the rejection rate of the faucet body, A made by casting is relatively high, and that the lead of which the faucet body A is made is a heavy metal hazardous to human health, and further that the repair work of the faucet body A can not be done easily.

SUMMARY OF THE INVENTION

The primary objective of the present invention is therefore to provide a gooseneck faucet which is free from the drawbacks of the prior art gooseneck faucet described above.

In keeping with the principle of the present invention, the foregoing objective of the present invention is attained by an improved gooseneck faucet, which is composed of a gooseneck tube, a faucet body and a threaded tube. The gooseneck tube has a spout which is provided with a protective jacket, and a water inlet which is provided with outer threads. The faucet body is made of a shell and an inner body contained in the shell. The shell is provided at the top end thereof with a water flow control valve hole and a water outlet, whereas the inner body is provided therein with a control valve water tract and a water discharging tract which is provided in the top portion thereof with inner threads. The inner body is further provided in the bottom portion thereof with a waterproof washer. The threaded tube is provided with a nut, a compression sleeve and a compression nut. The bottom seat ring, the leakproof washer and the metal washer are mounted on the threaded tube. The inner body of the faucet body can be made of various materials so as to bring about a reduction in the cost of making the gooseneck faucet.

The foregoing objective, features and functions of the present invention will be more readily understood upon a thoughtful deliberation of the following detailed description of an embodiment of the present invention with reference to the accompanying drawings.

DETAILED DESCRIPTION OF THE EMBODIMENT

Figure 1:
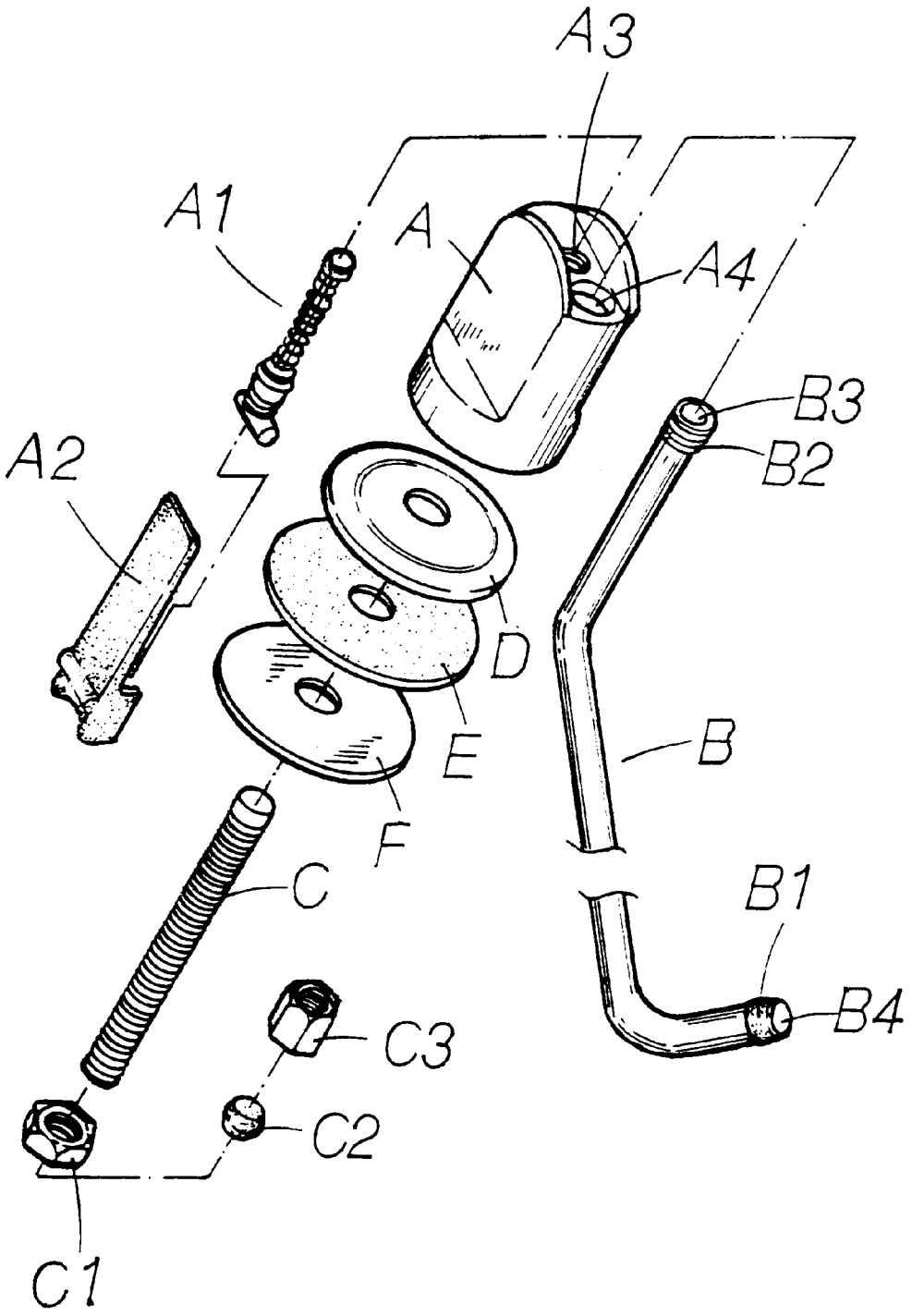
FIG. 1 PRIOR ART
FIG. 1 Shows an exploded view of a gooseneck faucet of the prior art.
Figure 2:
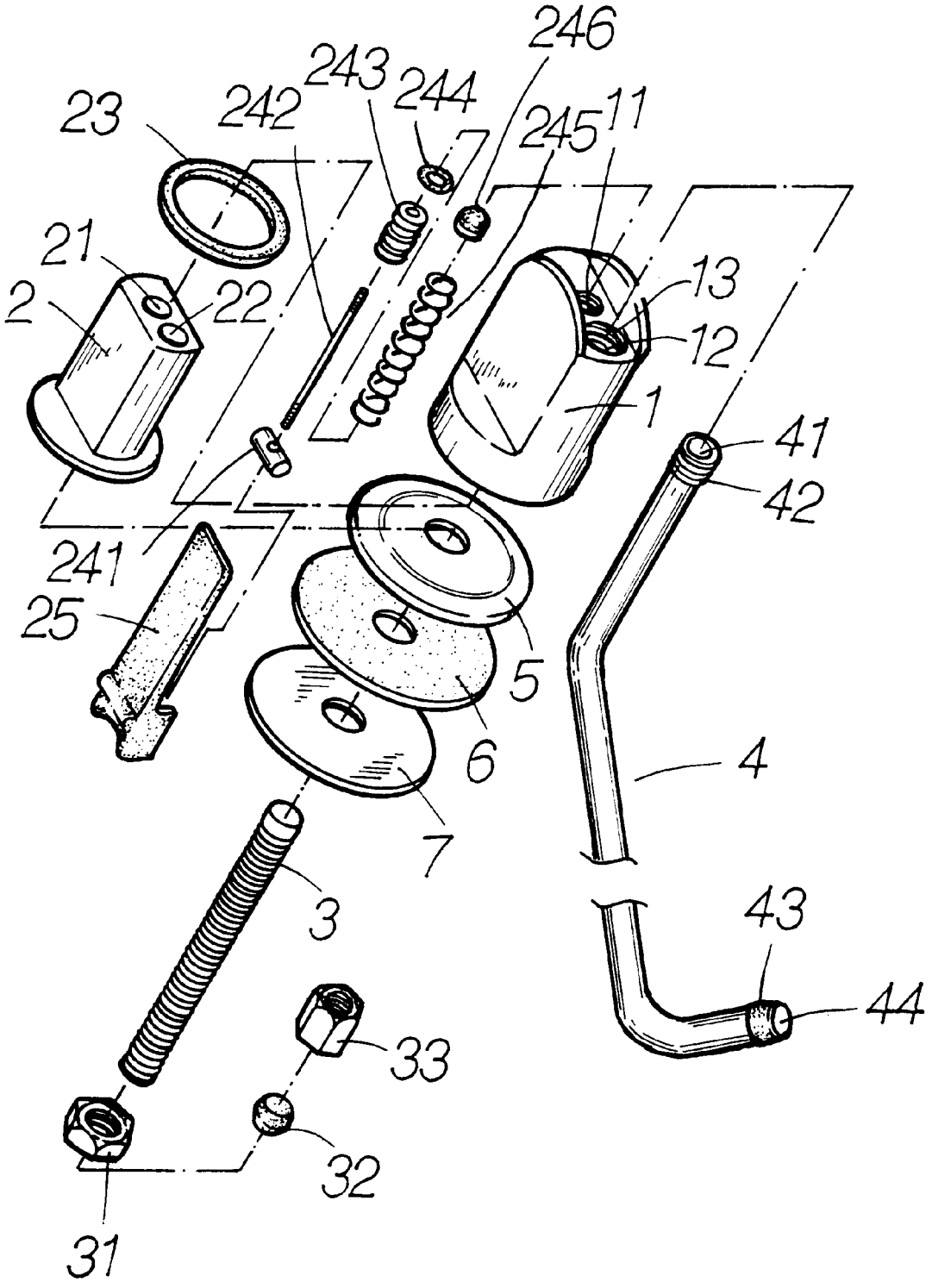
FIG. 2 shows an exploded view of a gooseneck faucet of the present invention.
Figure 3:
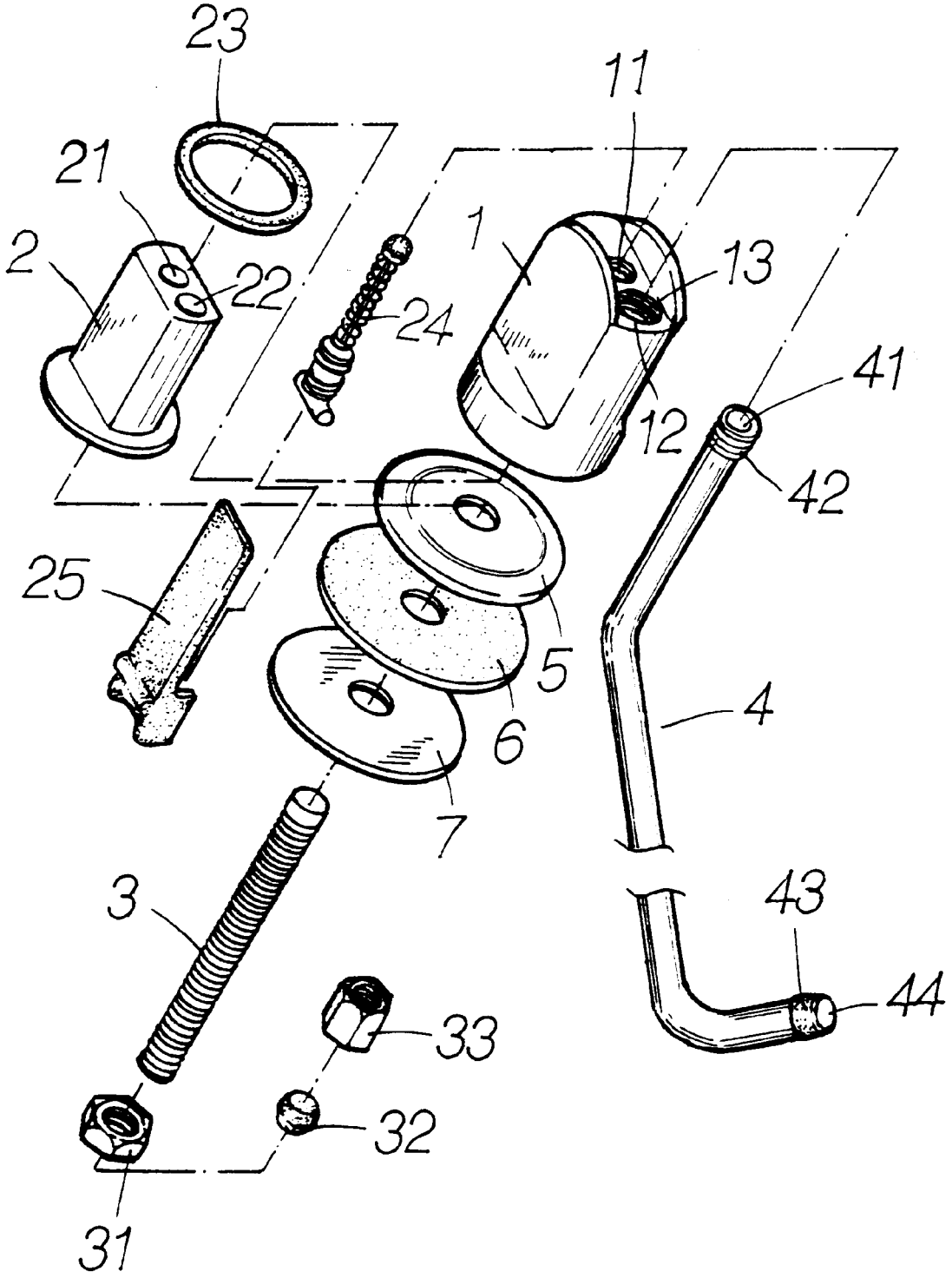
FIG. 3 shows another exploded view of the gooseneck faucet of the present invention.
Figure 4:
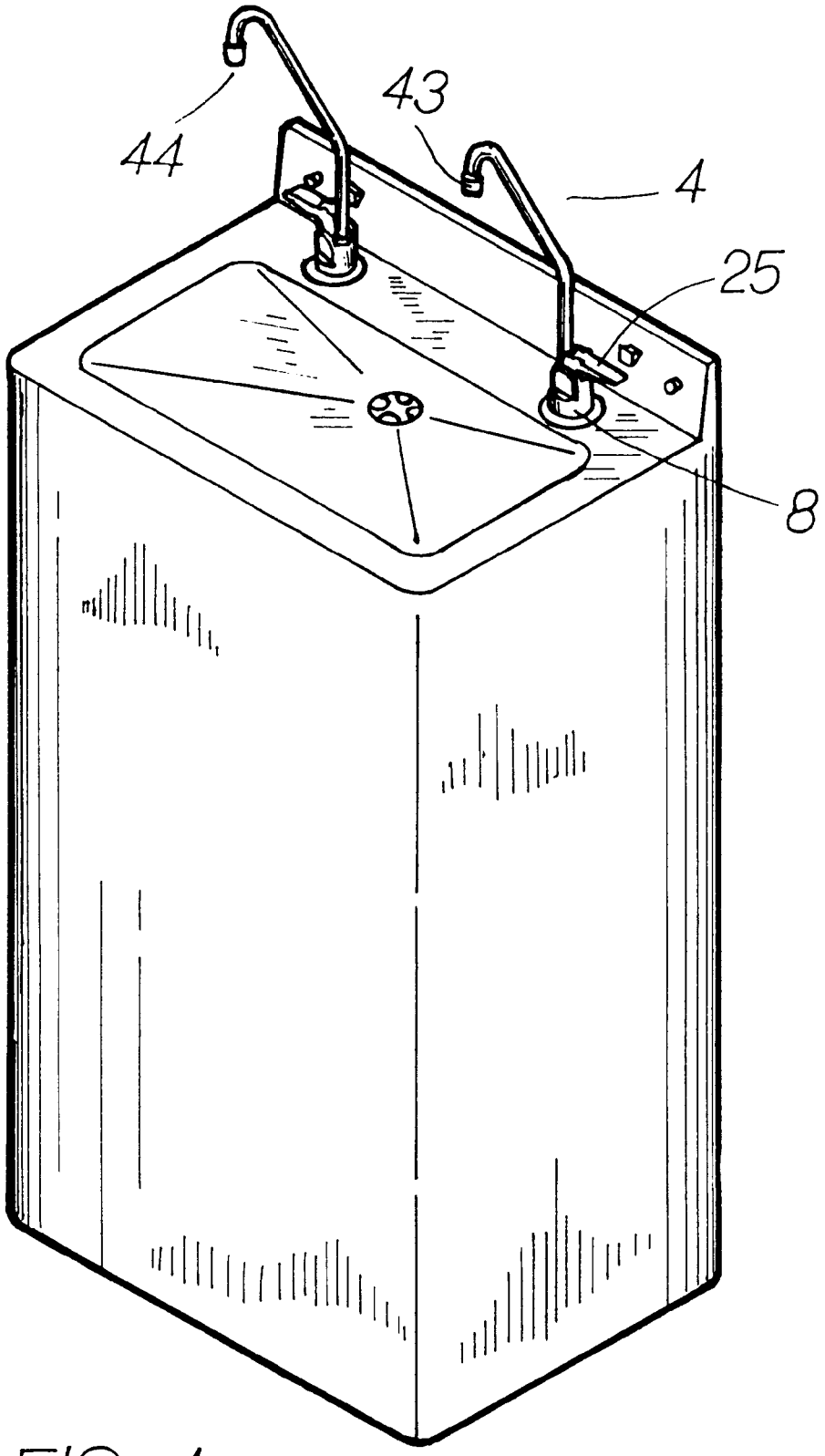
FIG. 4 is a schematic view showing that the gooseneck faucet of the present invention is used in conjunction with a drinking fountain.

As shown in FIGS. 2, 3 and 4, a gooseneck faucet embodied in the present invention is composed of a shell 1, an inner body 2, a threaded tube 3, and a gooseneck tube 4.

The gooseneck tube 4 has a spout 44 which is provided with a protective jacket 43. The gooseneck tube 4 further has a water inlet 41 which is provided with outer threads 42. The shell 1 and the inner body 2 form together a faucet body 8. The shell 1 is provided at the top thereof with a flow control valve hole 11 and water outlet 12 which is provided in the top thereof with inner threads 13, whereas the inner body 2 is provided therein with a control valve water tract 21 and a water discharging tract 22. The control valve water tract 21 is provided therein with a control valve 24 which is composed of a combination rod 241, a bar 242, a hollow sleeve 243, a washer 244, a spring 245, and a leakproof block 246. The control valve 24 is provided with a press handle 25. The inner body 2 is further provided in the bottom thereof with a waterproof washer 23. The threaded tube 3 is provided with a nut 31, a compression sleeve 32 and a compression nut 33. A bottom seat ring 5 , a sealing washer 6 and a metal washer 7 are mounted on the threaded tube 3.

As illustrated in FIG. 4, the gooseneck tube 4 is fastened at one end thereof with the faucet body 8 such that the outer threads 42 of the water inlet 41 of the gooseneck tube 4 are engaged with the inner threads 13 of the water outlet 12. In the meantime, the threaded tube 3 is fastened securely with the bottom end of the control valve water tract 21 of the faucet body 8. The gooseneck faucet of the present invention is fastened with a drinking fountain by the fastening nut 31.

The faucet body 8 of the gooseneck faucet of the present invention is made up of the shell 1 and the inner body 2, which are made of a plastic material or a cast iron material in place of lead. As a result the gooseneck faucet of the present invention can be made at a relatively low cost and without being detrimental to the health of the workers who make the gooseneck faucet.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A gooseneck faucet comprising:

a gooseneck tube provided at one end thereof with a spout, and at another end thereof with a water inlet having outer threads;

a faucet body composed of an outer shell having an upper end and a lower end thereof, said shell having in the upper end thereof a flow control valve hole and a water outlet hole defined therethrough, said water outlet hole having inner threads provided therein, said lower end of said outer shell having an open space defined therein, and an inner body, positioned within said open space defined in said lower end of said outer shell, said inner body having a control valve water tract and a water discharging tract defined therethrough, which tracts correspond with said flow control valve hole and said water outlet hole of said outer shell; and a threaded tube provided with a fastening nut, a compression sleeve and a compression nut;

said gooseneck tube fastened at said another end thereof with said faucet body such that said outer threads of said water inlet of said gooseneck tube are engaged with said inner threads of said water outlet of said shell of said faucet body;

wherein said threaded tube is fastened at one end thereof with one end of said control valve water tract of said inner body of said faucet body, said threaded tube further being fastened at another end thereof with a drinking fountain in conjunction with said fastening nut.

2. The gooseneck faucet as defined in claim 1, wherein said spout of said gooseneck tube is provided with a protective jacket fastened therewith.

3. The Gooseneck faucet as defined in claim 1, wherein said faucet body is made of a plastic material or a cast iron.

4. The gooseneck faucet as defined in claim 1, wherein said control valve water tract of said inner body of said faucet body is provided with a control valve which is in turn provided with a press handle fastened therewith.

5. The gooseneck faucet as defined in claim 1, wherein said threaded tube is provided with a plurality of washers mounted thereon.

6. The gooseneck faucet as defined in claim 1, further comprising:

a waterproof washer provided at the bottom of the inner body.

* * * * *